US005851144A

United States Patent [19]

Nyström

[11] Patent Number: 5,851,144

[45] Date of Patent: Dec. 22, 1998

[54] METHOD AND DEVICE FOR SUPPLYING AIR TO A VENTILATED SPACE

[75] Inventor: Bernt Nyström, Stockholm, Sweden

[73] Assignee: Air Innovation Sweden AB, Stockholm, Sweden

[21] Appl. No.: 858,827

[22] Filed: May 19, 1997

Related U.S. Application Data

[63] Continuation of Ser. No. 532,609, Oct. 12, 1995, abandoned.

[30] Foreign Application Priority Data

Apr. 14, 1993 [SE] Sweden ..... 9301225

[51] Int. Cl.[6] ..... F24F 13/06

[52] U.S. Cl. ..... 454/306; 454/906

[58] Field of Search ..... 454/231, 284, 454/306, 906; 138/156, 157, 158, 159, 163

[56] References Cited

U.S. PATENT DOCUMENTS

| | | | |
|---|---|---|---|
| 304,789 | 9/1884 | Butz | 138/159 |
| 434,845 | 8/1890 | George | 138/157 X |
| 2,275,572 | 3/1942 | Somers | 138/157 |
| 3,359,883 | 12/1967 | Murphy | 454/306 |
| 3,835,606 | 9/1974 | Liberman . | |
| 4,020,753 | 5/1977 | Efstratis | 454/306 |
| 4,481,871 | 11/1984 | Efstratis | 454/306 |
| 4,558,526 | 12/1985 | Baus | 454/284 X |
| 4,850,266 | 7/1989 | Bennett | 454/306 X |
| 4,852,470 | 8/1989 | Corriveau | 454/306 X |
| 5,197,920 | 3/1993 | Ganse | 454/306 X |

FOREIGN PATENT DOCUMENTS

| | | |
|---|---|---|
| 2 263 617 | 7/1974 | Germany . |
| 38 10 482 | 10/1989 | Germany . |
| 40 22 392 | 1/1992 | Germany . |
| 42 22 064 | 1/1993 | Germany . |
| 370 274 | 1/1973 | Sweden . |
| 2 218 196 | 11/1989 | United Kingdom . |

*Primary Examiner*—Harold Joyce
*Attorney, Agent, or Firm*—Hill & Simpson

[57] ABSTRACT

When introducing supply air into a treated space (A), the supply air is conveyed from a source (B) of supply air by way of a terminal device (10) opening into the treated space, the supply air being discharged from the terminal device (10) with a certain momentum substantially vertically and downwardly along an upstanding surface (E) defining the treated space. In a supply air terminal device for introducing the supply air the air passageway (13) between the supply air intake and the supply air outlet is elongate, and the terminal device (10) is adapted to be mounted in a vertical position on an upstanding surface (E) defining the ventilated space (A) with the supply air outlet directed downwardly and positioned adjacent said defining surface.

9 Claims, 2 Drawing Sheets

METHOD AND DEVICE FOR SUPPLYING AIR TO A VENTILATED SPACE

This is a continuation of application Ser. No. 08/532,609, filed Oct. 12, 1995 abandoned.

BACKGROUND OF THE INVENTION

This invention relates to a method of introducing supply air (ventilating air) into a treated or ventilated space, in which the supply air is conveyed from a source of supply air by way of a terminal device opening into the ventilated space. Moreover, the invention relates to a supply air terminal device for carrying the method into effect.

It is known to introduce supply air into a ventilated space by means of a so-called displacing supply air terminal device. The supply air is introduced horizontally at a low and uniform velocity into the ventilated space at the floor zone of that space and caused to progressively displace the overlying air towards the ceiling area where it is discharged way of exhaust air terminal devices.

SUMMARY OF THE INVENTION

The present invention also relates to a method and a supply air terminal device for air-displacing type ventilation.

What primarily characterises the method according to the invention is that the supply air is discharged from the supply air terminal device along an upstanding surface which defines the ventilated space. The jet of air coming from the terminal device flows along said defining surface, which may be a wall of a room, and is spread over the floor zone of the treated space, and as it spreads it mixes with the surrounding air. Within the treated space an air motion is produced which is virtually unnoticeable to persons which occupy the space.

The air may be discharged from the supply air terminal device at a level which may be high above the floor, but preferably the air discharge is effected 80–120 cm above the floor level.

The invention provides great freedom when choosing the location where the supply air is introduced into the ventilated space. The floor surface and the space close to the floor may be left free, and the supply air terminal can be designed and positioned so as to be aesthetically attractive.

The supply air terminal device according to the invention is primarily characterised in that the air passageway between the supply air intake and the supply air outlet is elongate and in that the device is adapted to be mounted in a vertical position on an upstanding surface defining the ventilated space and with the supply air outlet directed downwardly and positioned adjacent said defining surface.

The air passageway between the supply air intake and the supply air outlet may be formed by a channel member which is open on one side, the surface on which the terminal device is to be mounted serving to define the air passageway at the open side, so that the air passageway has a closed cross-section. Spacer members of suitable dimensions may be mounted on the lateral edges of the channel member so that the channel member will be positioned at a distance from the wall surface which matches the desired cross-sectional flow area.

The invention will be described in the greater detail below with reference to the accompanying drawings.

DETAILED DESCRIPTION OF THE PREFERRED EMBODIMENTS

Figure 1:
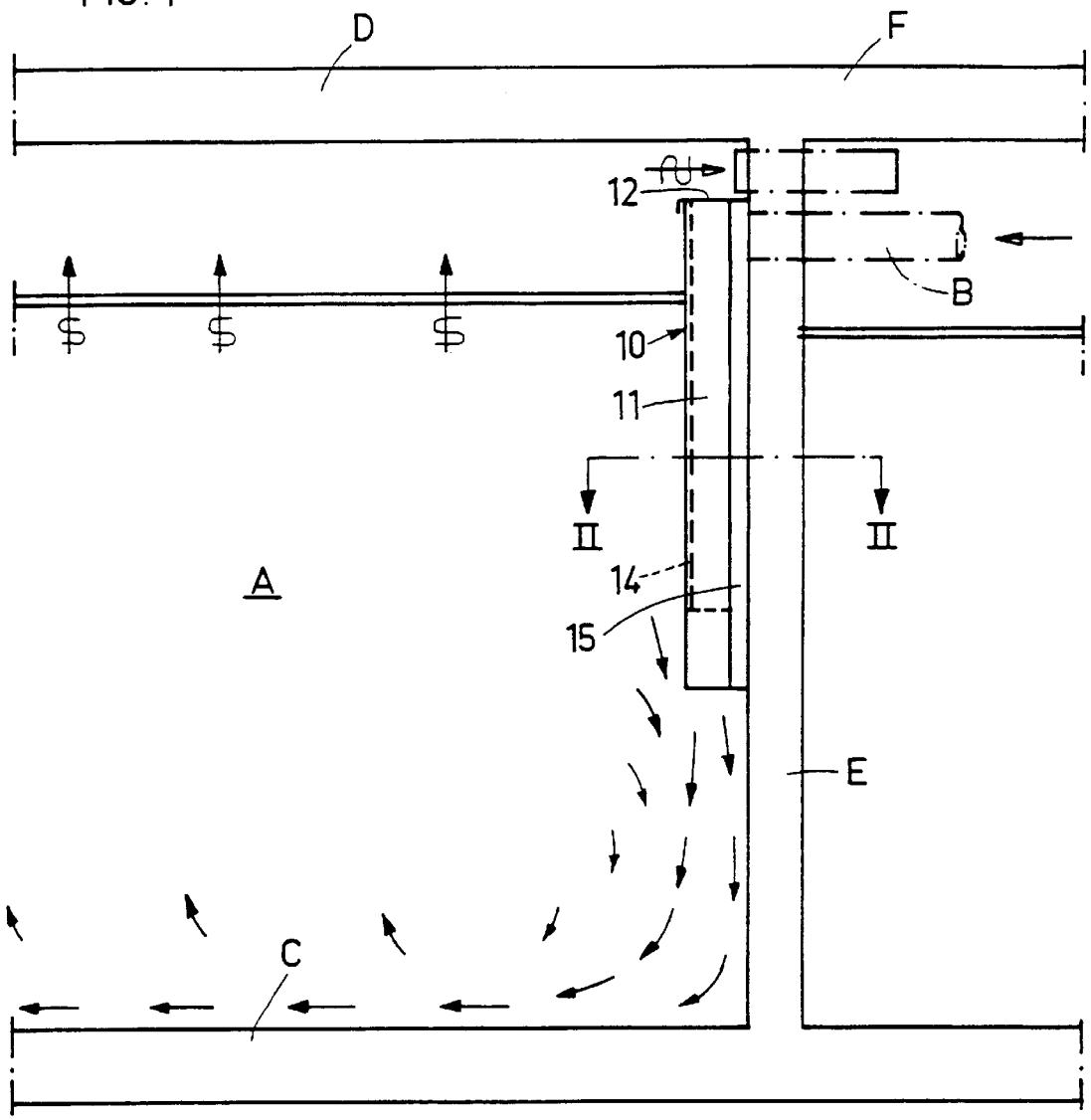
FIG. 1 schematically illustrates a room which is ventilated in accordance with the invention.

FIG. 1 illustrates a ventilated space A, which may be, for example, a dwelling or office room, into which supply air is introduced from a source of supply air in shape of, for example, a fan or an air-conditioner (not shown) and an associated supply air conduit B, by way of a supply air terminal device which is generally designated by 10. Air is discharged from the ventilated space A, which is defined by the floor C, the ceiling D and a wall E, by way of an exhaust air terminal device F.

The supply air terminal device 10 is in the shape of an elongate channel member 11 of V-shaped cross-section which is open at one end and closed by a transverse wall 12 at the other, upper end. Alternatively, the channel member 11 may be closed against the ceiling D at its upper end. The channel member 11 is mounted directly on the wall in a vertical position with the closed end up and the open end down, the wall E of the room forming a wall of the vertical air passageway 13 formed by the channel member.

At its upper portion, adjacent to the transverse wall 12, the channel member is connected through its open side with the supply air channel B. Accordingly, in the embodiment shown in FIG. 1, the supply air terminal device has no separate portion forming its intake, which is instead constituted by that portion of the open side of the channel member which is positioned in register with the supply air channel B (in other embodiments, the air may be supplied in a different way, e.g. from above). In a corresponding manner, the outlet of the supply air terminal device is formed by the downwardly directed open end of the channel member.

The interior surface of the channel member 11 is coated with an insulating layer 14 which ends slightly above the lower end of the channel member. The insulating layer is dimensioned in accordance the requirements for sound absorption.

At its lateral edges, the channel member 11 is defined by a flange member 15 which sealingly engages the wall E when the supply air terminal device 10 is mounted in position.

Figure 3:
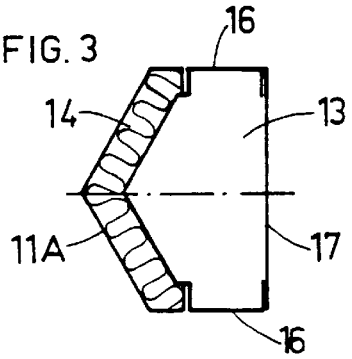
FIG. 3 is a cross-sectional view similar to FIG. 2 and illustrates a modified cross-sectional shape.

In the modified embodiment according to FIG. 3, the lateral edges of the channel member A are provided with a separate, removably mounted spacer member 16 formed by an U-profile member. Spacer members of this kind can be supplied in certain predetermined widths, so that the spacing of the channel member from the wall, and thus the cross-sectional flow area of the air passageway 13, can be selected according to the rate of flow of air through the supply air terminal device. Moreover, a rear member 17 is provided, which is formed of a plate mounted on one of the rear or outer flanges of the spacer member 16. The rear member 17 closes the channel member between the spacer members and is provided with a recess for connection of the supply air channel B.

Because of its velocity, the air flowing from the supply air channel B and through the air passageway 13 has a vertical downward momentum, and when it discharges from the terminal device 10 it will proceed downwardly along the wall under the Coanda effect to be deflected at the floor C and spread along the floor as is indicated by arrows in FIG. 1. The air which is already in the ventilated space A, is displaced upwardly to the ceiling zone from which it is carried away by way of the exhaust air terminal device F.

As is readily appreciated, the channel member 11 may be cut off from a longer piece to the length desired in each particular case, so that the length, and thus the level of the air outlet above the floor, can readily be chosen at will. The exterior surface of the supply air terminal device can be designed and treated or decorated in a multiplicity of different ways, and the supply air terminal device can be used for adornment and other interior decoration purposes.

Figure 2:
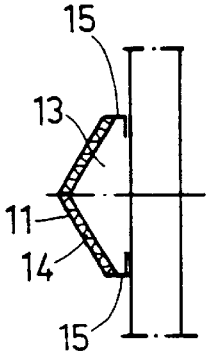
FIG. 2 is a cross-sectional view on line II—II of FIG. 1 and illustrates the cross-sectional shape of the supply air terminal device.
Figure 4:
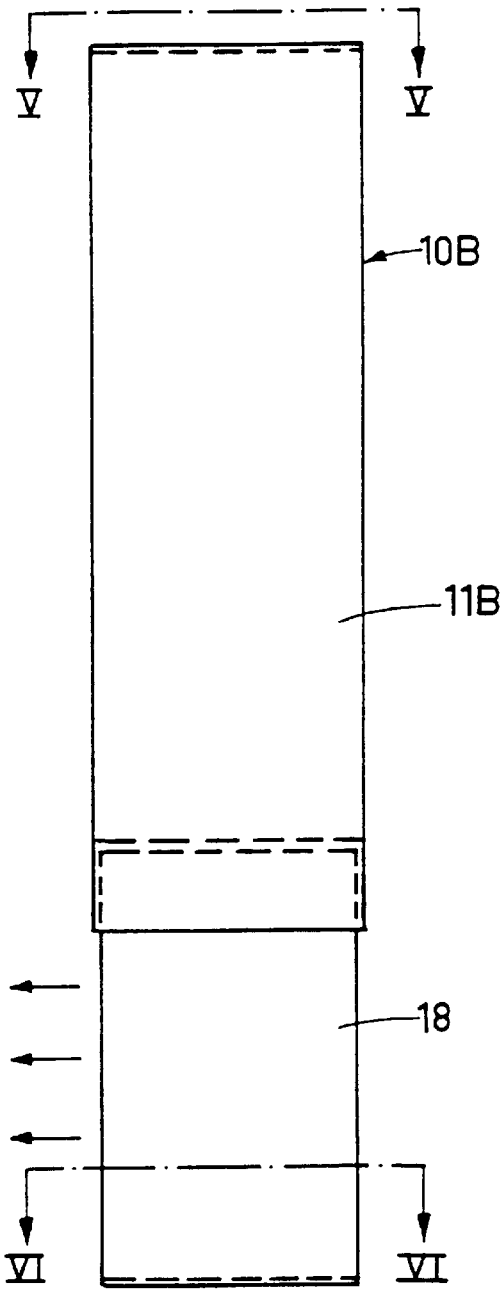
FIG. 4 is an elevational view of a further modified supply air terminal device provided with an attachment or extension member.
Figure 5:
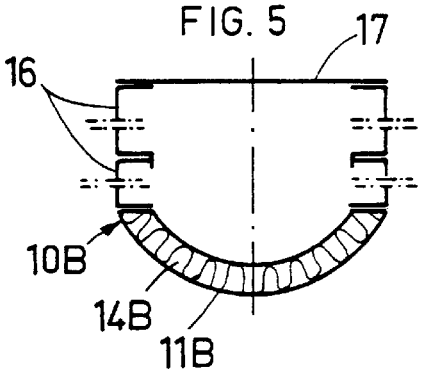
FIG. 5 is a cross-sectional view on line V—V of FIG. 4.
Figure 6:
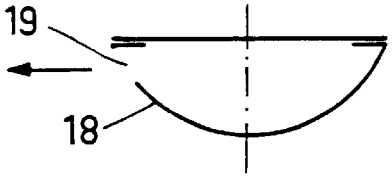
FIG. 6 is a cross-sectional view on line VI—VI of FIG. 4.

FIGS. 4–6 show a modified embodiment of the supply air terminal device which is in this case designated by 10B. The channel member 11B is made as a part of a circular cylinder, and as in the previous embodiment it is provided interiorly with an insulating layer 14B. Moreover, spacer members 16B similar to the spacer members 16 of FIGS. 1–3 are provided.

Furthermore, as in FIG. 3, a rear member 17 is provided which is in the shape of a plate removably attached to the outermost spacer member to close the channel member between the lateral edges thereof and which is provided with a recess for connecting the supply air channel B.

Apart from that, the supply air terminal device 10B differs from the supply air terminal 10 substantially only by the cross-sectional shape of the channel member 11B.

In FIGS. 4–6 the channel member is, however, supplemented by an extension member 18, which is telescopically mounted in the lower portion of the channel member 11B. The extension member forms an extension of the air passageway 13, but in contrast to the latter it is not open downwardly but on one side; as is shown in FIG. 6, the extension member 18 is provided with an outlet opening 19 along one lateral edge through which the supply air is discharged. Naturally, a similar outlet opening may be provided at the other side as well.

The length of the supply air terminal device according to the invention is not particularly critical, but it should be adequate to ensure that the Coanda effect is obtained, so that the jet of air exiting from the outlet of the terminal device will be a surface jet.

Naturally, the terminal device according to the invention is primarily intended to serve as a supply air terminal device, but as is readily appreciated, it can also serve as an exhaust air terminal device or a terminal device for transmitted air.

Although the present invention has been described with reference to a specific embodiment, those of skill in the art will recognize that changes may be made thereto without departing from the scope and spirit of the invention as set forth in the appended claims.

I claim as my invention:

1. A method for introducing supply air into a ventilated space, in which the supply air is conveyed from a source of supply air by way of a terminal device opening into the ventilated space, comprising the step of discharging substantially all the supply air from the supply air terminal device downwardly along and against an upstanding surface which defines the ventilated space under the Coanda effect.

2. A method according to claim 1, characterised in that the supply air is discharged from the supply air terminal device into the ventilated space 80–120 cm above a floor of the ventilated space.

3. A supply air terminal device for introducing supply air into a ventilated space, comprising;

a supply air intake and a supply air outlet, and an elongate air passageway between the supply air intake and the supply air outlet in that the terminal device is adapted to be mounted in a vertical position on an upstanding surface defining the ventilated space with the supply air outlet positioned adjacent said upstanding surface, the terminal device oriented for directing airflow out of said supply air outlet downwardly along and against said surface under the Coanda effect.

4. The supply air terminal device according to claim 3, wherein the air passageway between the supply air intake and the supply air outlet is formed by a channel member which is open on one side, the terminal device being adapted to be mounted on said defining surface with said open side facing said surface.

5. The supply air terminal device according to claim 3, wherein the air passageway between the supply air intake and the supply air outlet comprises a trough-shaped part and is provided with one or more spacer members mounted along the lateral edges of the trough-shaped part.

6. The supply air terminal device according to claim 3, wherein the length of the air passageway between the supply air intake and the supply air outlet is at least twice the largest cross-sectional dimension of the passageway.

7. The supply air terminal device according to claim 4, wherein the channel member comprises a trough-shaped part and is provided with one or more spacer members mounted along the lateral edges of the trough-shaped part.

8. The supply air terminal device according to claim 4, wherein the length of the air passageway between the supply air intake and the supply air outlet is at least twice the largest cross-sectional dimension of the passageway.

9. The supply air terminal device according to claim 5, wherein the length of the air passageway between the supply air intake and the supply air outlet is at least twice the largest cross-sectional dimension of the passageway.

* * * * *